United States Patent [19]

Bamford et al.

[11] Patent Number: 4,657,320

[45] Date of Patent: Apr. 14, 1987

[54] HINGEABLE ELECTRICAL CONNECTOR

[75] Inventors: William C. Bamford, Yamato; Yasuhiro Ichijo, Yokohama, both of Japan

[73] Assignee: Molex Incorporated, Lisle, Ill.

[21] Appl. No.: 639,762

[22] Filed: Aug. 13, 1984

[30] Foreign Application Priority Data

Sep. 28, 1983 [JP] Japan ..... 58-178343

[51] Int. Cl.[4] ..... H01R 39/00

[52] U.S. Cl. ..... 339/4; 339/6 R; 339/59 M; 339/17 LM

[58] Field of Search ..... 339/4, 17 LC, 17 C, 339/17 LM, 17 M, 221 M, 218 M, 91 R, 47 R, 47 C, 277, 59 R, 59 M, 259 R, 259 F

[56] References Cited

U.S. PATENT DOCUMENTS

| | | | |
|---|---|---|---|
| 3,376,479 | 4/1968 | Wines et al. | 339/4 |
| 3,601,746 | 8/1971 | Teagno | 339/4 |
| 3,691,430 | 9/1972 | Freitag | 339/91 R |
| 3,853,380 | 12/1974 | Baker | 339/91 R |
| 3,923,365 | 12/1975 | Lynch | 339/221 R |
| 4,036,544 | 7/1977 | Keglewitsch | 339/221 M |
| 4,273,401 | 6/1981 | Katzin | 339/47 R |
| 4,357,070 | 11/1982 | Fukushima et al. | 339/47 C |
| 4,506,940 | 3/1985 | Asick et al. | 339/217 S |

FOREIGN PATENT DOCUMENTS

| | | | |
|---|---|---|---|
| 376848 | 5/1973 | U.S.S.R. | 339/259 R |

*Primary Examiner*—Gil Weidenfeld
*Assistant Examiner*—David Pirlot
*Attorney, Agent, or Firm*—Louis A. Hecht; John W. Cornell

[57] ABSTRACT

An electrical connector assembly for first and second pivotally mounted circuit members includes a dielectric housing portion for each member, each portion having a plurality of terminal receiving cavities formed therein, with first and second sets of terminals mounted therein. The housing portions are joined together for pivoting about an axis of rotation. Each terminal of each housing portion has a mating contact surface centrally located with respect to the axis of rotation. A compressive bias force is applied between mating terminal pairs which extends along the axis of rotation.

3 Claims, 6 Drawing Figures

HINGEABLE ELECTRICAL CONNECTOR

BACKGROUND OF THE INVENTION

1. Field of the Invention

The present invention relates to an electrical connector assembly, and in particular, to an assembly which permits two circuit members to be both mechanically and electrically connected during selective rotation of the circuit members, one with respect to the other.

2. Description of the Prior Art

The current and increasing reliance upon semi-conductor technology in the design and manufacture of complex electronic equipment has stimulated significant demand for electrical interconnection systems which permit such equipment to be both compact and easily maintained. Often, a modular approach to arrangement of constituant electronic components is desirable. For example, where the equipment requires the use of redundant components, modular circuitry subassemblies offer significant economies in both initial manufacture and replacement. These subassemblies may typically include a relatively rigid substrate, such as a printed circuit board, on which a plurality of circuit devices have been mounted and electrically interconnected. It is common practice to, in turn, mount the circuitry modules within a larger apparatus and electrically connect them to other components or modules.

In many such applications, it may be desirable to connect a pair of circuit boards together both mechanically and electrically. To this end, a variety of connector systems are available, such as that disclosed in Carter, et al, U.S. Pat. No. 4,386,815, wherein a so-called mother/daughter board interconnection arrangement is disclosed. A system of this type permits one circuit board to be used as a structural support for a plurality of other circuit board modules through the use of electrical connectors.

In other applications, it might be desirable to interconnect a pair of circuit boards such that they are movable, one with respect to another, yet remain electrically interconnected during such movement. Such an arrangement is particularly advantageous in the case of compact electronic equipment which requires occasional servicing. The circuit board modules may, thereby, be selectively repositioned and yet remain functional during a servicing operation. One such example of the foregoing arrangement is the hinged type connector disclosed in Corns, U.S. Pat. No. 3,362,005 issued Jan. 2, 1968, directed to a flexible jumper for connecting printed circuit boards. However, with the jumper approach, the printed circuit boards cannot be disconnected from one another without rigorous disassembly methods and, with aging, the jumpers are known to fail.

In another known arrangement, a pair of circuit boards may be electrically and mechanically coupled by utilization of a pair of mating terminals. For example, the connector shown by Katzin, U.S. Pat. No. 4,273,401 issued June 16, 1981, comprises a pair of plate-like terminals adapted to slide together and become electrically interengaging upon pivotable movement one with respect to the other. In practice, however, such a system can be undesirable because of the edge contact configuration utilized therein, which results in a high degree of attendant wear because of the high contact forces generated between the mating terminals. Moreover, the circuit boards may become accidentally disconnected if they are inadvertently rotated to the position at which the terminal members are meant to be separated.

SUMMARY OF THE INVENTION

It is, therefore, an object of the present invention to provide an improved connector for effecting a continuous electrical connection between two circuit members while permitting the circuit members to be pivoted one with respect to the other.

It is another object to provide a connector for effecting releaseable, rotatable electrical contact between a pair of circuit members.

According to the present invention, an electrical connector assembly for establishing electrical contact between a pair of circuit elements comprises a pair of mating terminals each adapted to form electrical contact with one of the circuit elements and cooperating to permit the circuit elements to be pivoted, one with respect to the other, along a axis of rotation. Each of the terminals has a generally plate-like contact portion defining a contact surface oriented substantially normally to the axis of rotation. In addition, means are provided for biasing the contact surfaces together in rotatable electrical interengagement. One of the terminals may have a protrusion in its contact surface disposed centrally of the axis of rotation for enhancing the electrical interface between the terminals.

BRIEF DESCRIPTION OF THE DRAWINGS

Other objects, features and advantages of the invention will become apparent from a reading of the specification when taken in conjunction with the accompanying drawings in which.

DESCRIPTION OF THE PREFERRED EMBODIMENT

Figure 1:
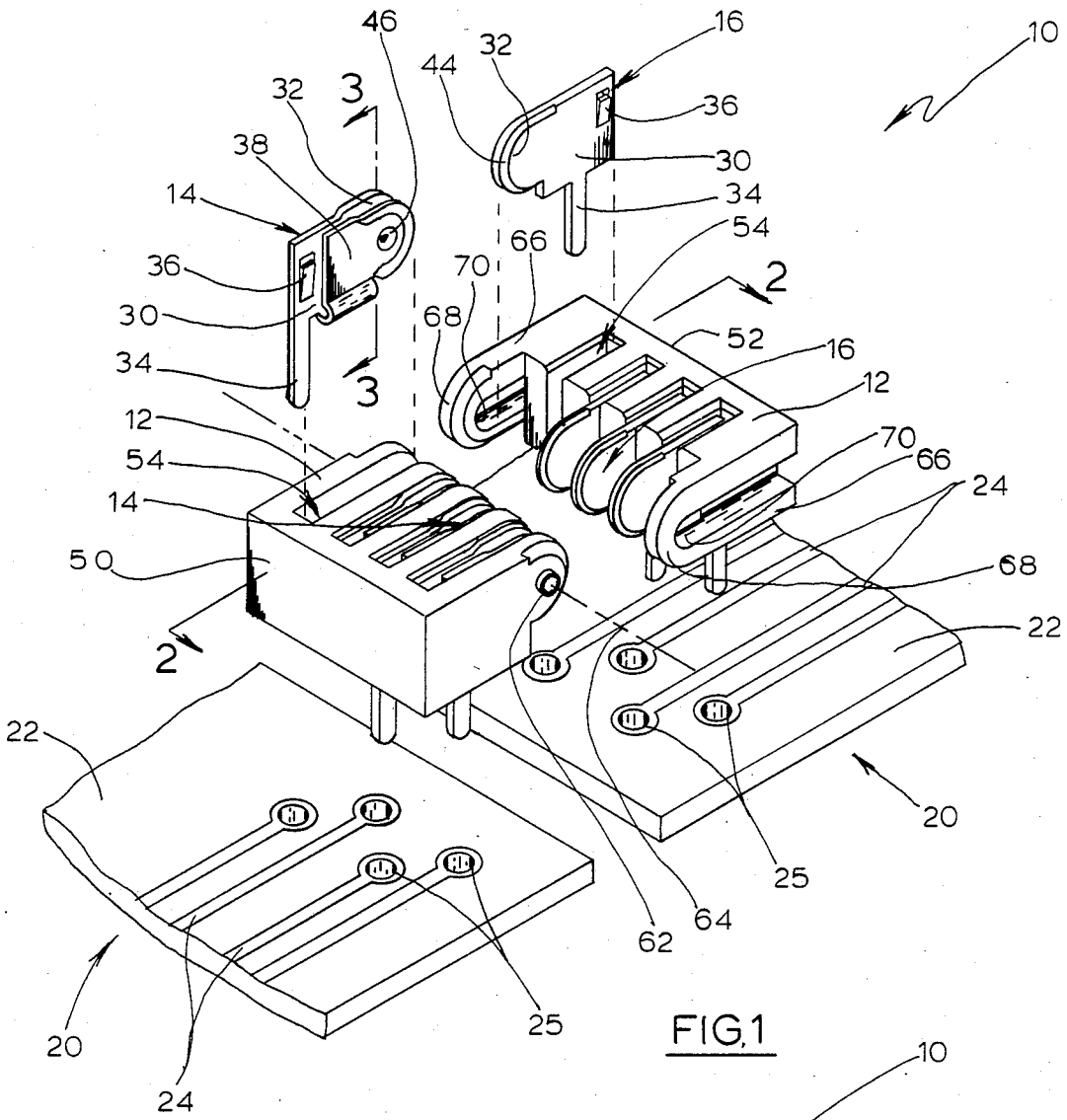
FIG. 1 is an exploded perspective view of an electrical connector assembly in accordance with the present invention.
Figure 2:
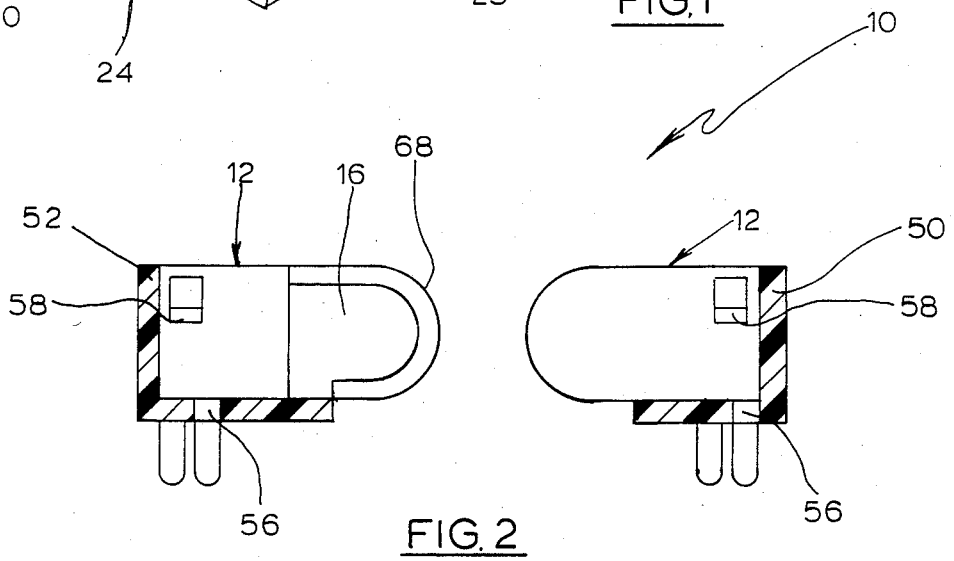
FIG. 2 is a sectional view of the housing assembly as viewed generally along the line 2—2 of FIG. 1.

An electrical connector assembly 10 using a separable hinge construction in accordance with the invention is depicted in the drawings of FIGS. 1, 2 and 4. The assembly 10 is seen to include a two-piece housing 12 fitted with a plurality of mating terminals which are distinguishable as a female terminal 14 and a male terminal 16. In the example depicted, the connector assembly provides both a mechanical and electrical connection between a pair of like circuit elements, designated generally by the reference numeral 20.

The circuit elements 20 comprise a relatively rigid insulative substrate 22, on which a plurality of circuit paths 24 have been defined, commonly referred to as circuit boards. Although not specifically shown, in a manner well-known in the art the circuit boards 20 may carry a number of circuit devices, and connection of the devices to other apparatus is provided by means of circuit path terminations 25 capable of forming electrical connections with the assembly 10.

The terminals 14 and 16 are preferably stamped and formed from sheet metal having a high quality of electrical conductivity. If required by environmental conditions, they may also be plated with one of several noble metals, thereby enhancing their conductive characteristics. Each terminal 14 amd 16 is formed with a body portion 30 from which an integral contact portion 32 depends.

To effect termination to the circuit paths 24 of the boards 22, a generally elongated pin 34 extends from body portion 30. As best shown in FIG. 1, these pins 34 may be so disposed with respect to the terminal body 30 in adjacent terminals 14 or 16 as to create a staggered pin configuration, thereby allowing for closer sidewise spacing of both the terminals 14 and 16 and the circuit paths 24. A locking lance 36 extends from a side of each terminal 14 and 16 for purposes which will be described in greater detail hereinafter.

Figure 3:
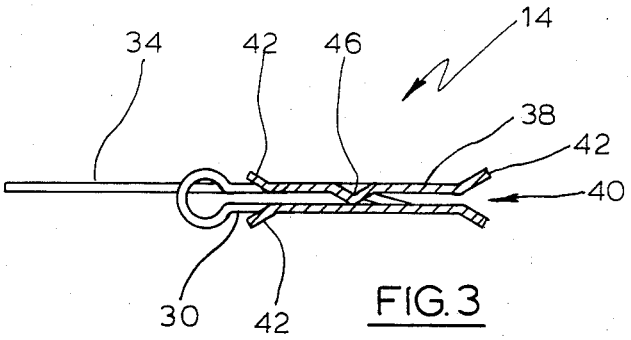
FIG. 3 is a sectional view taken generally along line 3—3 of FIG. 1 and illustrating the cross section of the female terminal of the present assembly.

With reference now to FIGS. 1 and 3, the female terminal 14 can be seen to include a reversely bent plate portion 38 defining, essentially, a double-walled receptacle 40 for slidingly receiving the contact portion 32 of the male terminal 16. The edges of contact portion 32 of the female terminal 14 are formed with lips 42 turned generally outwardly in relation to the receptacle 40. In addition to strengthening the terminal 14, the lips 42 serve as guides for insertion of the male terminal 16 therebetween. Insertion is also enhanced by chamfered edges 44 of the male terminal 16. Protrusions 46 are formed in plate portion 38 and extend inwardly into the receptacle 40 for reasons which will be described, hereinafter.

The housing 12 is molded from suitable dielectric material and comprises two distinct pieces, i.e. a portion 50 for mounting female terminals 14 and a portion 52 for mounting male terminals 16. Although the terminals 14 and 16 are functional when used by themselves, the housing 12 provides for a more mechanically stable assembly, in that recesses 54 of the housing portions 50 and 52 maintain the terminals 14 in isolated, immovable relationship one with respect to the other. Further, and as best seen in FIG. 2, apertures 56 formed in the underside of the housing portions 50 and 52 serve to receive and positively locate the pin portions 34 of the terminals 14 and 16. Suitable lands 58 are formed within the recesses 54 for cooperation with the locking lances 36 thereby preventing withdrawal of the terminals 14 and 16 from their seated position within the housing 12.

In order to facilitate a separable hinge relationship between the terminals 14 and 16, the female housing portion 50 is adapted with a pair of trunnions 62 aligned along a predetermined axis of rotation, designated generally by the reference numeral 64. Correspondingly, the male housing portion 52 is configured with a complementary yoke 66 comprising a pair of arms 68 having suitably dimensioned bores 70 for journalling of the trunnions 62. The arms 68 are sufficiently resilient such that they can be manually pressed either into or out of engagement with the trunnions 62 when separation or rejoining of the housing portions 50 and 52 is desired.

The axis of rotation 64 is so disposed with respect to the housing 12 that the plate-like contact portions 32 of pairs of mating terminals 14 and 16 are in alignment with each other. Moreover, the protrusions 46 are preferably arranged centrally of the axis of rotation 64, thereby minimizing relative movement at the contact interface between the terminals 14 and 16 and reducing attendant wear.

It can be appreciated that extremely high contact forces are achievable between the terminals 14 and 16 by selective dimensioning of the recesses 54 of the female housing portion 50. With the recesses 54 sufficiently narrow, the receptacle 40 will assume a biased state upon insertion of the male terminal 16, due to natural resilience of the housing 50, generally. Likewise, inherent resilience of the protrusions 46 contributes to biasing of the terminals 14 and 16 in their mated condition.

Figure 4A:
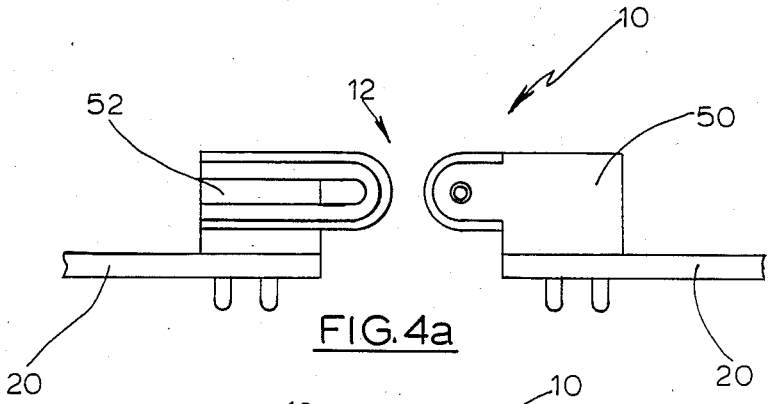
FIGS. 4*a*, 4*b* and 4*c* illustrate, in perspective, a variety of circuit board configurations using a connector assembly in accordance with the invention.
Figure 4B:
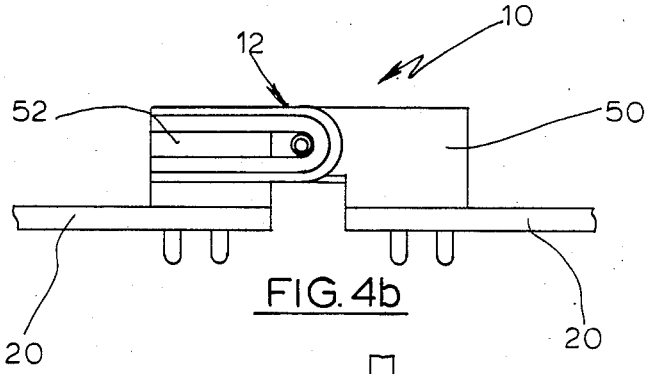
Figure 4C:
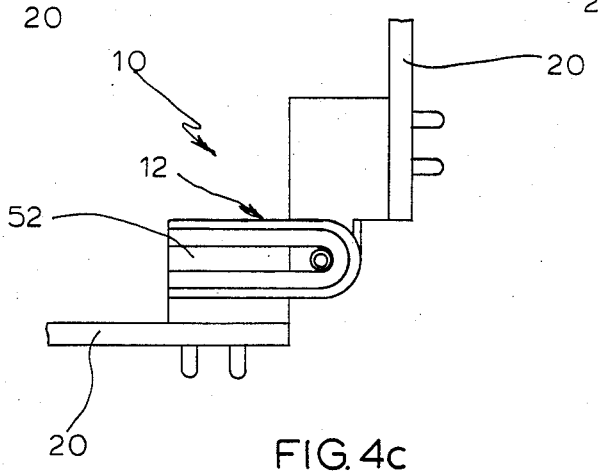

From the foregoing description, it should be apparent that the instant connector assembly 10 provides a means for selectively coupling a pair of circuit members in pivotable relation, with reliable mechanical and electrical stability. Although a pair of circuit boards has been illustrated, the circuit elements 20 may consist of virtually any apparatus which requires electrical connection to another member. As illustrated in FIGS. 4*a*, 4*b* and 4*c* a wide range of flexure and extension modes as between the two elements 20 is made possible by the invention. The described pivoting movements may be repeated over numerous cycles without appreciable wearing of the contact interface due to the action of the protrusions 46, as described above.

We claim:

1. An electrical connector assembly for establishing electrical contact between first and second connector portions associated with one of a pair of pivotally mounted circuit members, said assembly including each connector portion having a dielectric housing portion, a plurality of terminal receiving cavities formed therein, and first and second sets of terminals mounted within corresponding cavities of the first and second connector portions, respectively, the first set of terminals being mateable with the second set of terminals to form mating terminal pairs, and means for pivotally joining said housing portions together for rotation about an axis, the improvement in said connector assembly comprising:

each terminal of said first and second sets of terminals having a mating plate-like contact surface located on said axis of rotation; and said terminal receiving cavities of said first connector portion are defined by resilient housing walls so configured so as to bias together a mating terminal pair received therein with a compressive bias force extending along said axis of rotation.

2. The assembly of claim 1 wherein said first set of terminals comprise receptacle members having a pair of opposed plates one plate having a resilient central protrusion opposing the other plate and enhancing said compressive bias force when mated with one of said second set of terminals.

3. The assembly of claim 2 wherein each terminal of said first and second sets of terminals comprise stamped disks of similar size and shape.

* * * * *